US005357321A

United States Patent [19]

Stenzel et al.

[11] Patent Number: 5,357,321

[45] Date of Patent: Oct. 18, 1994

[54] DRUM SUPPORTING HUB AND DRUM ASSEMBLY

[75] Inventors: James G. Stenzel, Rochester; Edward P. Imes, Ontario, both of N.Y.

[73] Assignee: Xerox Corporation, Stamford, Conn.

[21] Appl. No.: 177,033

[22] Filed: Jan. 4, 1994

[51] Int. Cl.[5] ..... G03G 15/00

[52] U.S. Cl. ..... 355/211; 492/47

[58] Field of Search ..... 355/211, 210, 200; 492/21, 47

[56] References Cited

U.S. PATENT DOCUMENTS

| | | | |
|---|---|---|---|
| 3,536,397 | 10/1970 | Van Wagner | 355/211 |
| 4,040,157 | 8/1977 | Shanly | 355/211 |
| 4,105,345 | 8/1978 | Van Wagner | 355/211 |
| 4,120,576 | 10/1978 | Babish | 355/211 |
| 4,134,667 | 1/1979 | Schnall et al. | 355/211 |
| 4,134,669 | 1/1979 | Reitner | 355/211 |
| 4,161,357 | 7/1979 | Herman et al. | 355/211 |
| 4,165,169 | 8/1979 | Miyashita et al. | 355/211 |
| 4,326,793 | 4/1982 | Buholtz | 355/211 |
| 4,527,883 | 7/1985 | Kamiyama | 355/211 |
| 4,561,763 | 12/1985 | Basch | 355/3 DR |
| 4,839,690 | 6/1989 | Onoda et al. | 355/211 |
| 4,975,743 | 12/1990 | Surti | 355/211 |
| 5,023,660 | 6/1991 | Ebata et al. | 355/200 |
| 5,038,172 | 8/1991 | Schreyer | 355/211 |
| 5,052,090 | 10/1991 | Kitaura et al. | 355/211 X |
| 5,151,737 | 9/1992 | Johnson et al. | 355/211 |
| 5,210,574 | 5/1993 | Kita | 355/211 |
| 5,313,255 | 5/1994 | Taniguchi et al. | 355/211 |

*Primary Examiner*—R. L. Moses

[57] ABSTRACT

A drum supporting hub including a disk shaped member having a circular periphery, a hole extending axially through the center of the disk shaped member, and at least one long thin electrically conductive resilient member secured to the disk shaped member, the resilient member having a central section adjacent the hole and having opposite ends, each of the ends terminating into at least one pointed tip adjacent the circular periphery of the disk shaped member, and the resilient member having a major plane substantially parallel to the axis of the disk shaped member. This hub may be inserted in at least one end of a cylindrical electrostatographic imaging member to produce an imaging member assembly.

15 Claims, 6 Drawing Sheets

DRUM SUPPORTING HUB AND DRUM ASSEMBLY

BACKGROUND OF THE INVENTION

This invention relates in general to drum support apparatus and more specifically to a drum supporting hub, a drum assembly containing the hub and method for fabricating the drum assembly.

A photoreceptor conventionally utilized for copiers and printers comprises a hollow electrically conductive cylindrical drum substrate which has been dip coated with various coatings including at least one photoconductive coating comprising pigment particles dispersed in a film-forming binder. These drum type photoreceptors are supported on an electrically conductive shaft by drum supporting hubs. The hubs are usually constructed of plastic material and have a hole through their center into which a supporting axle shaft is inserted. Since hubs are usually constructed of electrically insulating plastic material, an electrical grounding means comprising a flexible spring steel metal strip is secured to the hub and positioned to contact both the electrically conductive axle shaft and the electrically conductive metal substrate of the photoreceptor drum. One type of grounding means is illustrated in U.S. Pat. No. 4,561,763. This metal ground strip is often bent out of alignment when inserted into one end of a photoreceptor drum. Such misalignment can result in the metal strip not contacting the interior of the drum or the axle or both after insertion of the hub into the end of the drum is completed. Further, coatings electrically insulating in the dark that are formed on the surface of the interior of the drum during dip coating can adversely affect electrical grounding of the drum to the electrically conductive drum axle shaft. If inadequate electrical grounding of the drum to the axle shaft is detected after the drum has been inserted into a modular replacement unit in which photoreceptor and various other subsystems such as cleaning and charging units are permanently mounted, repair of the drum is usually impossible without destruction of the module. Often the hub is secured to the end of the drum by a thermosetting resin. Recycling of used drums having glued hubs is difficult, if not impossible, because of damage to the hub or the drum or both during removal of the hub from the drum by common techniques such as by hammering. Such removal techniques damage or destroy both the drum and the hub. The use of bolts and nuts to secure hubs to drums requires time intensive activity and does not address the problem of electrically grounding a drum substrate to the drum axle shaft.

Thus, there is a continuing need for improved photoreceptors that are more reliable and facilitate recycling.

INFORMATION DISCLOSURE STATEMENT

U.S. Pat. No. 4,561,763 to D. Basch issued on Dec. 31, 1985 a drum supporting hub is disclosed having a tapered pot-like hub configuration comprising a bottom section and a rim, the rim comprising a plurality of circumferentially spaced resilient fingers extending at a slight incline outwardly from the axis of the pot-like hub away from the bottom section, at least three of the fingers having lips at the ends of the fingers, the lips projecting away from the axis for engagement with an end of a cylindrical drum upon insertion of the pot-like hub into the drum, the rim other than the lips having an outside diameter slightly larger than the outside diameter of the bottom. The drum supporting hub is employed in a drum assembly comprising the hub, a cylindrical drum having a circular cross-section and a shaft positioned along the axis of the drum. A metal shim is utilized to electrically ground the drum to the shaft.

SUMMARY OF THE INVENTION

It is, therefore, an object of the present invention to provide an improved drum supporting hub and drum assembly which overcomes the above-noted disadvantages.

It is another object of this invention to provide an improved drum supporting hub and drum assembly which achieve excellent electrical grounding of an electrostatographic substrate which does not degrade overtime.

It is still another object of this invention to provide an improved drum supporting hub and drum assembly which facilitate recycling of electrostatographic drums and hubs.

It is yet another object of this invention to provide an improved drum supporting hub and drum assembly which reduces the number of assembly steps utilized to manufacture an electrostatographic drum.

It is another object of this invention to provide an improved drum supporting hub and drum assembly which eliminates the need for gluing to mount a hub to the end of an electrostatographic drum.

It is another object of this invention to provide an improved drum supporting hub and drum assembly which quickly achieves excellent anchoring of the hub to the drum.

The foregoing and other objects of the present invention are accomplished by providing a drum supporting hub comprising a disk shaped member having a circular periphery, a hole extending axially through the center of the disk shaped member, and at least one long thin electrically conductive resilient member secured to the disk shaped member, the resilient member having a central section adjacent the hole and having opposite ends, each of the ends terminating into at least one pointed tip adjacent the circular periphery of the disk shaped member, and the resilient member having a major plane substantially parallel to the axis of the disk shaped member. This hub may be inserted in at least one end of a cylindrical electrostatographic imaging member to produce an imaging member assembly.

BRIEF DESCRIPTION OF THE DRAWINGS

In general, the advantages of the improved drum supporting hub and drum assembly will become apparent upon consideration of the following disclosure of the invention, particularly when taken in conjunction with the accompanying drawings wherein.

These figures merely schematically illustrate the invention and are not intended to indicate relative size and dimensions of actual devices components thereof.

DETAILED DESCRIPTION OF THE DRAWINGS

The present invention may be employed in any suitable device that requires support for a drum. However, for purposes of illustration, the invention will be described with reference to an electrostatographic imaging system. A typical electrophotographic imaging system is illustrated in U.S. Pat. No. 3,900,258 to R. F. Hoppner et al, the entire disclosure thereof being incorporated herein by reference.

Figure 1:
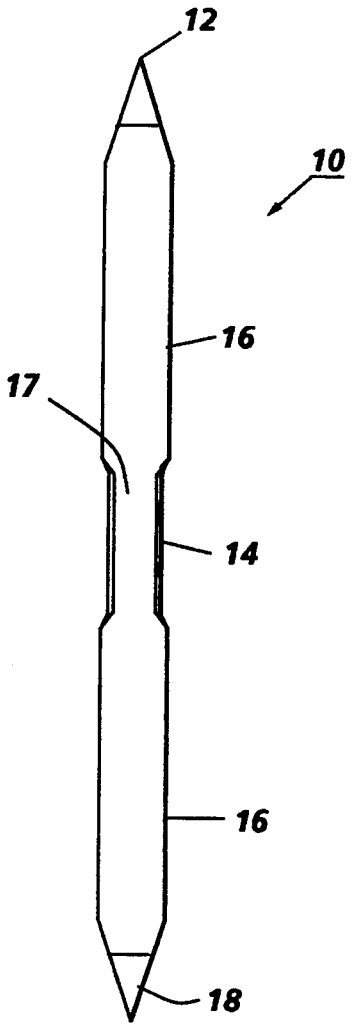
FIG. 1 is a schematic illustration of a long thin substantially flat electrically conductive resilient member utilized in the drum supporting hub of this invention.
Figure 2:
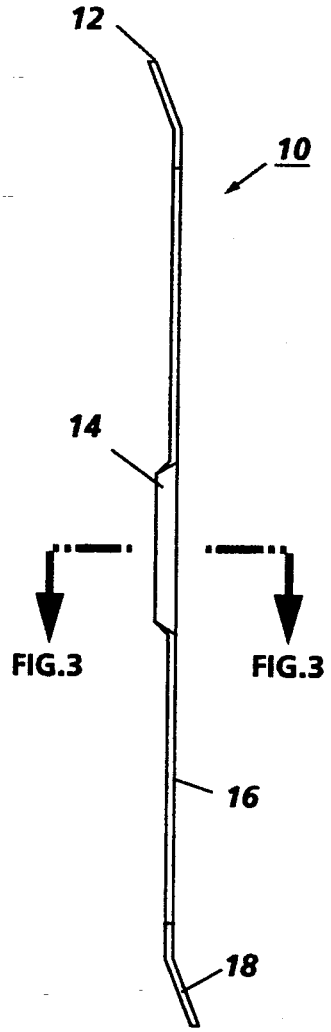
FIG. 2 is a schematic illustration of the resilient member illustrated in FIG. 1 viewed from one side.

Referring to FIGS. 1 and 2, a long thin substantially flat electrically conductive resilient member 10 is illustrated having opposite ends which terminate into at least one pointed tip 12. The ends of the resilient member 10 should have at least one pointed tip 12 to achieve embedding of the end of the resilient member into the interior surface of hollow cylindrical electrically conductive substrates (not shown) into the interior of which resilient member 10 is inserted. Resilient member 10 should be tapered at each end with the taper terminating in at least one point 12. The amount of taper does not appear critical but is desirable to facilitate insertion of the resilient member into the interior of the substrate when the drum supporting hub is inserted by a twisting motion. A taper may be used on both sides of tip 12 or on only one side, the other side being straight (not shown). Tip 12 and adjacent end region 18 of resilient member 10 are shown bent in opposite directions from each other in FIG. 2. Resilient member 10 has a central section 16, the center region 17 of which contains at least one flared edge 14. Any suitable material may be utilized for long thin substantially flat electrically conductive resilient member 10. Resilient member 10 should also be bendable, but resist permanent deformation. Preferably, resilient member 10 comprises a metal having hard, spring-like properties. Typical hard, spring-like metals include, for example, stainless steel, copper beryllium alloy, phosphorous bronze and the like or a conductive plastic. Resilient member 10 should have an electrical resistivity of less than about 1000 ohm cm. The specific material and length, width, and thickness selected affect the resiliency of resilient member 10. The width and thickness should be sufficient to resist permanent deformation and to retain the drum supporting hub (not shown) in position at at least one end of the hollow cylindrical drum. Typical physical widths are, for example, between about 0.2 centimeter and about 1 centimeter and typical thicknesses are between about 0.25 millimeter and about 1 millimeter.

Figure 3:
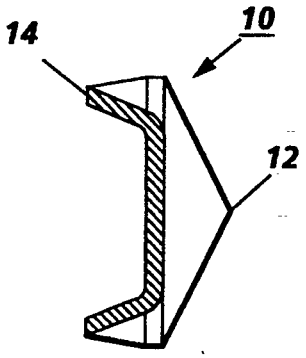
FIG. 3 is a cross section of the resilient member viewed in the direction illustrated by the arrows in FIG. 2.

In FIG. 3, a cross section of resilient member 10 is shown taken in the direction shown by the arrows illustrated in FIG. 2.

Figure 4:
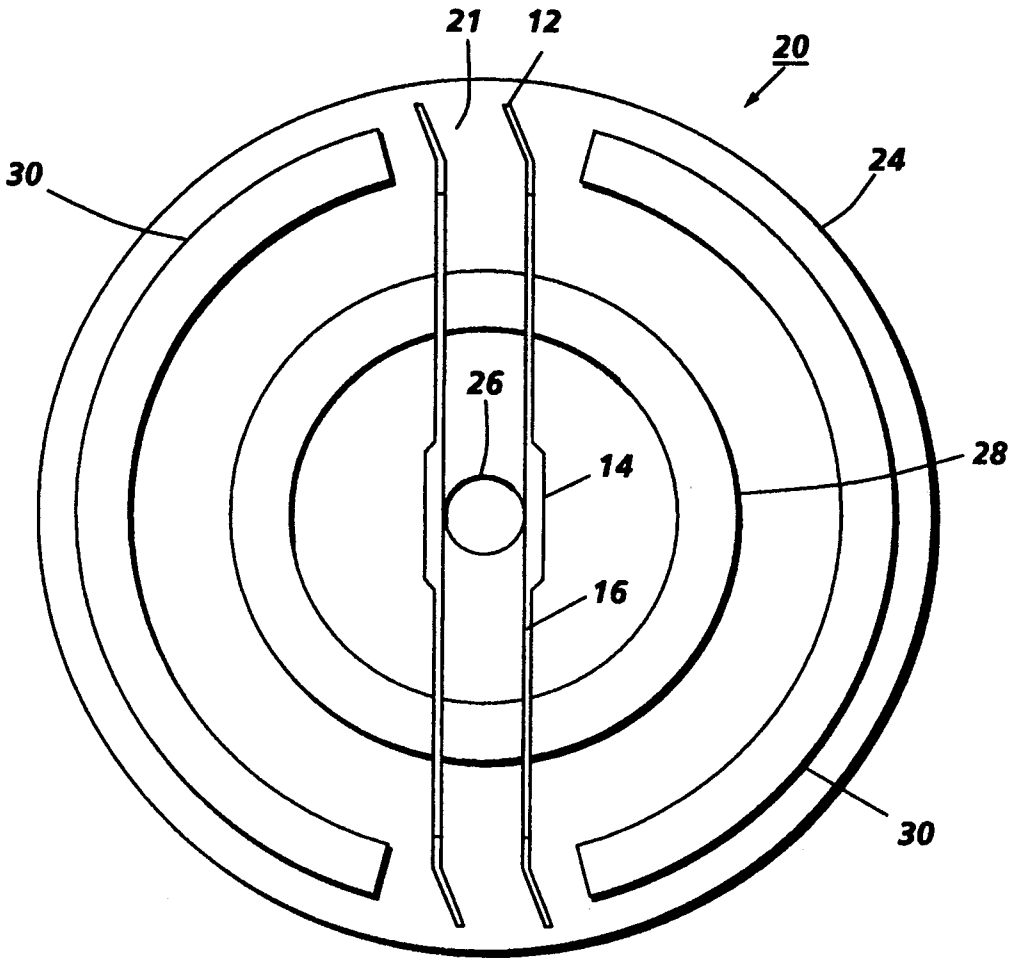
FIG. 4 is a drum supporting hub of this invention utilizing a pair of resilient members.

In FIG. 4, a drum supporting hub 20 is shown which comprises disk shaped member 21 to which is attached optional drive gear 22 having gear teeth 23 arranged around the periphery thereof. If desired, disk shaped member 21 and drive gear 22 may be formed as a unitary article by any suitable technique such as molding. Gear teeth 23 are adapted to engage with the teeth of another gear (not shown) connected to a suitable power source as is conventional in the art. Such an arrangement is well known in the art and is illustrated, for example, in U.S. Pat. No. 3,900,258 to R. F. Hoppner et al, the entire disclosure thereof being incorporated herein by reference. Alternatively, hub 20 may be driven directly by hexagonal or square axle shafts (not shown) which mate with correspondingly shaped openings in hub 20. The axle shaft can be driven directly by an electric motor (not shown) or by any other suitable power source as is well known in the art. Disk shaped member 21 has a circular periphery 24 and a centered hole 26. A circular rib or ridge 28 is formed as an integral part of the molded disk shaped member 21 by conventional processes such as molding. If desired, circular ridge 28 can be preformed and thereafter fastened to disk shaped member 21 by any suitable means such as by an adhesive, screw or the like. Circular ridge 28 secures a pair of spaced, parallel resilient elements 10 to disk shaped member 21 adjacent to hole 26. Disk shaped member 21 utilized in drum supporting hub 20 may be made of any suitable material such as plastic or metal. Typical plastic materials include thermosetting or thermoplastic resins which are dimensionally stable. These plastic members may be filled or unfilled. Any suitable conventional filling material may be utilized. Typical thermoplastic resins include, for example, acrilonitrile butadiene styrenes (ABS), polycarbonates, nylons, acrylics and the like. Typical thermosetting resins include, for example, alkyds, allylics, epoxies, phenolics, and the like. Although more expensive, metals such as steel, aluminum, copper, bronze, brass and the like may be utilized in disk shaped member 21.

Although resilient member 10 is shown secured to hub 20 by ridge 28 into which resilient member 10 is molded, it may be secured to disk shaped member 21 by any other suitable means. For example, resilient member 10 may be bolted or otherwise screwed to ridge 28 or other suitable projections extending toward the interior of a hollow cylindrical drum supported by hub 20. If desired, ridge 28 may contain slots in which the resilient member 10 is glued or secured by mechanical fastening means such as screws, clamps or the like.

The central section 16 of resilient members 10 have a major plane substantially parallel to the axis of hole 26. In other words, the larger surface rather than the thin edge surfaces of resilient members 10 will come into substantially tangential contact with the arcuate surface of the axle shaft (not shown) that will eventually be used to support the hub 20. Since resilient member 10 is substantially flat, the expression "major plane", as employed herein, is defined as in the plane of either side of the central section 16 of the large exposed surfaces of resilient member 10 rather than in the plane of either of the narrow edge surfaces of thin resilient member 10. Resilient members 10 are aligned so that they interfere slightly with the installation of an axle shaft (not shown) through hole 26 and bow slightly (not shown) away from the axle shaft after it is inserted between resilient members 10. This slight interference insures frictional and electrical contact after the axle shaft has been inserted through hole 26 and through the space between resilient members 10. Although a single long thin substantially flat electrically resilient member 10 may be utilized, a second resilient member 10 positioned on the other side of the axle shaft is preferred to achieve a balanced load on the axle shaft and to ensure electrical contact between the axle shaft and the interior of the hollow cylindrical electrically conductive substrate. To facilitate insertion of an axle shaft in the space between resilient members 10, flared edges 14 are provided on each resilient member to initially engage the end an axle shaft as it is inserted between resilient members 10. The flared edges 14 function as inclined planes to spread apart resilient members 10 and prevent damage to resilient members 10 when the axle shaft is inserted. The location of flared edge 14 depends on the direction in which the axle shaft is inserted. Thus, if the axle shaft is initially inserted into hole 26 prior to passage through the space between resilient members 10, flared edges 14 are located on the side of resilient members 10 closest to disk shaped member 21. However, if the axle shaft is initially inserted into the far end of a drum prior to passage through the space between resilient members 10, flared edges 14 are located on the side of resilient members 10 facing the far end of the drum. If the axle shaft might be inserted from either end of the drum, it is desirable that a flared edge 14 be provided on both edges of each resilient member 10.

Semi-circular drum alignment ridges 30 are also molded into disk shaped member 21. If desired, alignment ridges 30 can be preformed and thereafter fastened to disk shaped member 21 by any suitable means such as by an adhesive, screw or the like. Drum alignment ridges 30 ensures that drum supporting hub 20 is centered in the end of drum (not shown). If desired, the side of drum alignment ridge 30 facing the interior surface of the drum may be tapered, beveled or otherwise or inclined toward the drum centerline (not shown) to facilitate insertion of hub 20 into one end of the drum and to promote a snug fit between hub 20 and the drum. Thus, for example, drum alignment ridges 30 may have a truncated cross section. Alternatively, instead of using alignment ridges 30, a conventional recess (not shown) may be formed in circular periphery 24 to accept the end of a drum or a conventional recess (not shown) may be formed in the end of a drum adjacent the interior surface of the drum to accept hub 20.

Figure 5:
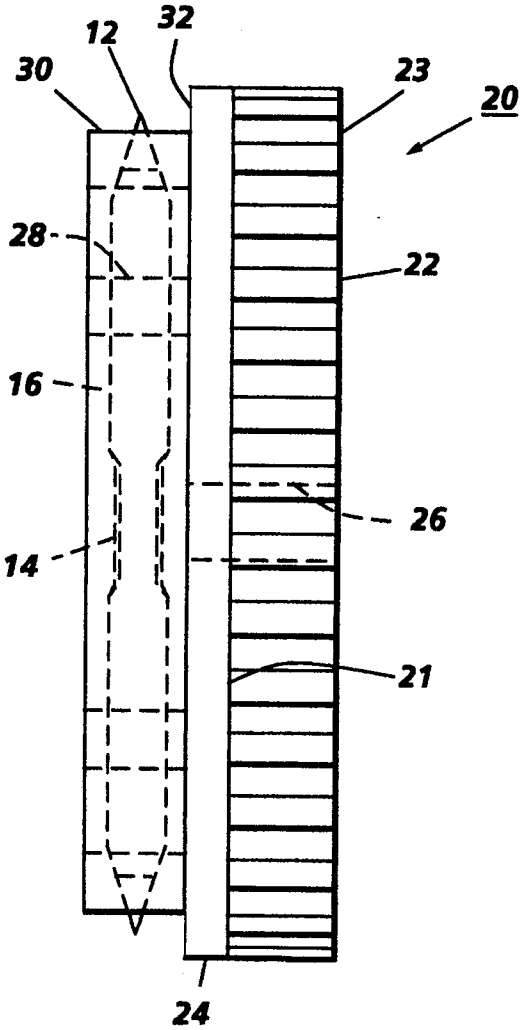
FIG. 5 is a schematic illustration of the drum supporting hub illustrated in FIG. 4 viewed from one side.

Prior to installation into the end of a drum, the pointed tips 12 of the resilient members 10 extend beyond the outer edge of semi-circular drum alignment ridge 30 as shown in FIGS. 4 and 5. The amount that resilient members 10 extend beyond the outer edge of semi-circular drum alignment ridge 30 should be sufficient to achieve compression of resilient member 10 and ensure positive engagement of pointed tips 12 with the interior surface of a cylindrical drum upon insertion of hub 20 into one end of the drum. Similarly, the opening between adjacent ends of alignment ridge 30 should be sufficiently wide to permit adequate movement of the resilient fingers 26 during insertion of the supporting hub 16 into the end of cylindrical drum 12 (see FIG. 6). In a typical example, the pointed tip of the resilient member extends about 1 millimeters (1/32) inch beyond the outer edge of the drum alignment ridge 30. The width of the sides of flared edge 14 should be sufficient to catch and guide axle shaft 40 when it is inserted into the hole of the drum supporting hub 20. A landing 32 is provided on the face of disk shaped member 21 to engage with and align supporting hub 20 with the drum into which supporting hub 20 is inserted. If desired, landing 32 may alternatively be formed as a recessed surface (not shown) cut or molded into circular periphery 24.

Figure 6:
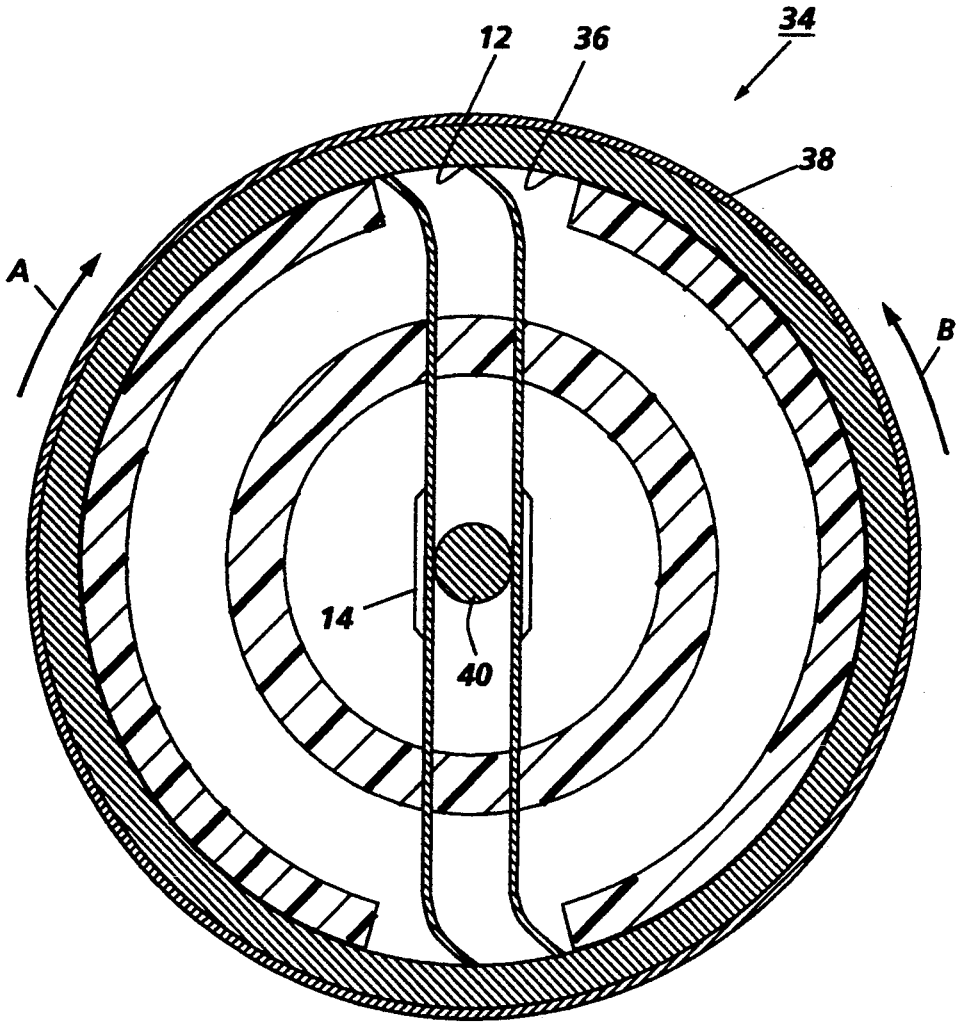
FIG. 6 is a schematic illustration of the drum supporting hub illustrated in FIG. 4 mounted in one end of an electrostatographic imaging member.
Figure 8:
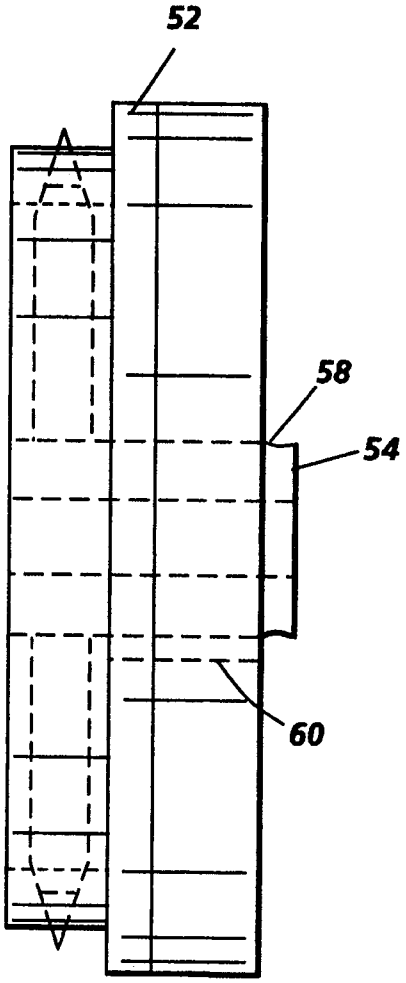
FIG. 8 is a schematic illustration of the drum supporting hub illustrated in FIG. 7 viewed from one side.

Referring to FIG. 6, drum supporting hub 20 is shown after it has been inserted into one end of an electrostatographic imaging drum 34. Electrostatographic imaging drum 34 comprises a hollow cylindrical electrically conductive substrate 36 and at least one electrostatographic layer 38. Electrostatographic layers are well known in the art and may comprise a dielectric layer for electrographic imaging or at least one electrophotographic imaging layer for electrophotographic imaging. An axle shaft 40 has been installed through hole 26 and in the space between resilient members 10. Flared edges 14 facilitated insertion of axle shaft 40 between resilient members 10. Since the space between resilient members 10 prior to insertion of axle shaft 40 is less than the diameter of axle shaft 40, frictional engagement between axle shaft 40 and resilient members 10 is achieved. Frictional engagement ensures electrical contact. This arrangement permits electrical grounding of drum 34 through resilient member 10 and shaft axle shaft 40.

Drum supporting hub 20 is inserted into the end of drum 34 with a twisting motion of either drum supporting hub 20 or drum 34, or both drum supporting hub 20 and drum 34. Preferably, end regions 18 at each end of resilient member 10 adjacent pointed tip 12 are bent at an angle of up to about 60 degrees measured from the original plane of resilient member 10 prior to bending to enhance the attack angle of pointed tip 12 into the interior surface of drum 34. A typical angle of attack is 30°. This prevents slippage between hub 20 and drum 34 when hub 34 is driven by any suitable means as drive gear 22. Preferably, the distance of the bend from pointed tip 12 is between about 2 millimeters and about 25 percent of the total length of resilient member 10. The direction of rotation for driving is in a direction which increases bite of the pointed tip into the substrate. When drum 34 is stationary and hub 20 is inserted into the end of drum 34 opposite the end closest to the viewer of FIG. 6, hub 20 is twisted in a clockwise direction. If hub 20 is held stationary, drum 34 is moved in a counter-clockwise direction when it is mounted onto hub 20. The twisting motion causes the bent adjacent end region 18 to bend even more thereby facilitating insertion of resilient members 10 into the interior of drum 34. When drum 34 is rotated by drive means which engage gear teeth 23 of drive gear 22, the direction of motion of hub 20 should be in the direction indicated by arrow B. This causes pointed tips 12 to further embed themselves into the interior surface of drum 34 to prevent slippage between drum 34 and hub 20. Avoidance of slippage assures registration of electrostatographic images and enhances achievement of quality electrostatographic images.

When it is desired to remove hub 20 from the end of drum 34 and drum 34 is to be held stationary, hub 20 should be twisted in the direction illustrated by arrow A in FIG. 6. Since hub 20 may be readily removed from drum 34 without damage to drum 34 or hub 20, both components may be easily recycled with less waste of material and less expenditure of time.

Figure 7:
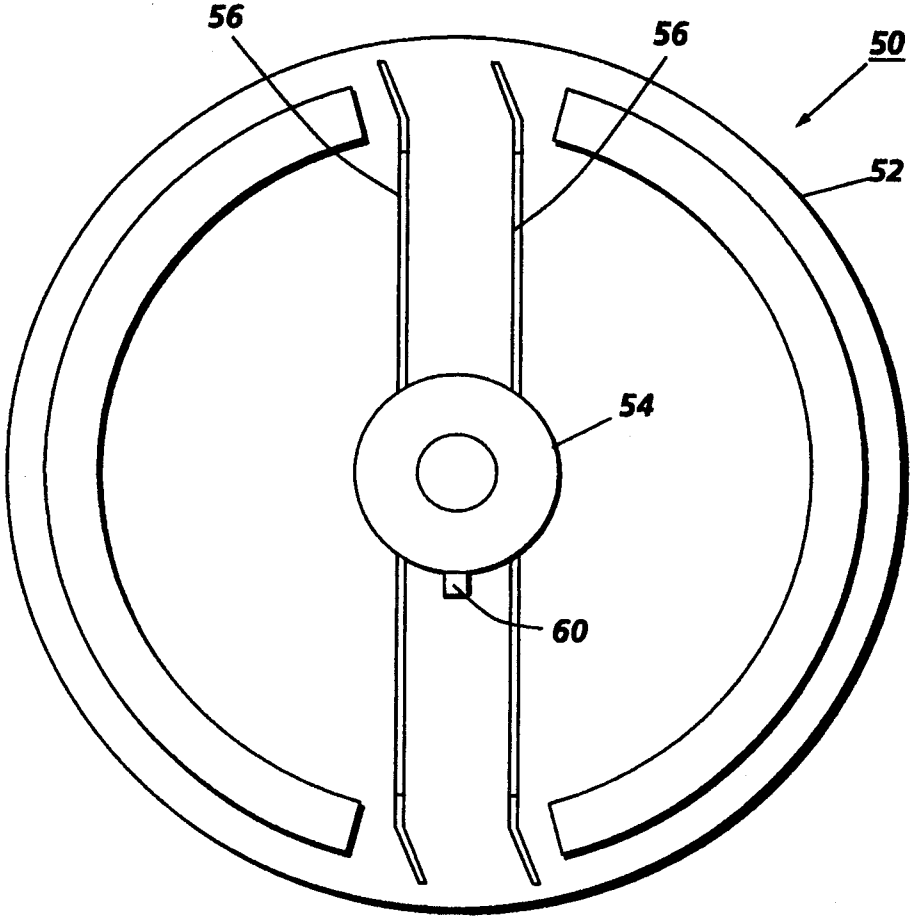
FIG. 7 is another embodiment of a drum supporting hub of this invention in which a pair of resilient members are supported by a bearing component of the drum supporting hub.

In FIG. 7, another embodiment is illustrated in which drum supporting hub 50 comprises an annular outer member 52 and a bearing member 54. A pair of long thin substantially flat electrically conductive resilient members 56 are molded into bearing member 54. Also molded into bearing member 54 is an annular retainer ridge 58 and a key 60. If desired, any other suitable means may be substituted for key 60 for securing bearing member 54 to annular outer member 52. Typical alternative means include, for example, collar in annular outer member 52 fitted with a set screw (not shown). Bearing member 54 along with resilient members 56 can be readily mounted into annular outer member 52 by merely pressing bearing member 54 into a hole 62 located at the center of annular outer member 52 until retainer ridge 58 extends through to the opposite side of annular member 52 thereby locking bearing member 54 into annular outer member 52. If removal of bearing member 54 from annular outer member 52 is desirable at a later date, such removal may be readily facilitated by means of an ordinary punch. Key 60 of bearing member 54 engages a corresponding slot in hole 62 in annular outer member 52 to prevent rotation of bearing member 54 in hole 62.

Figure 9:
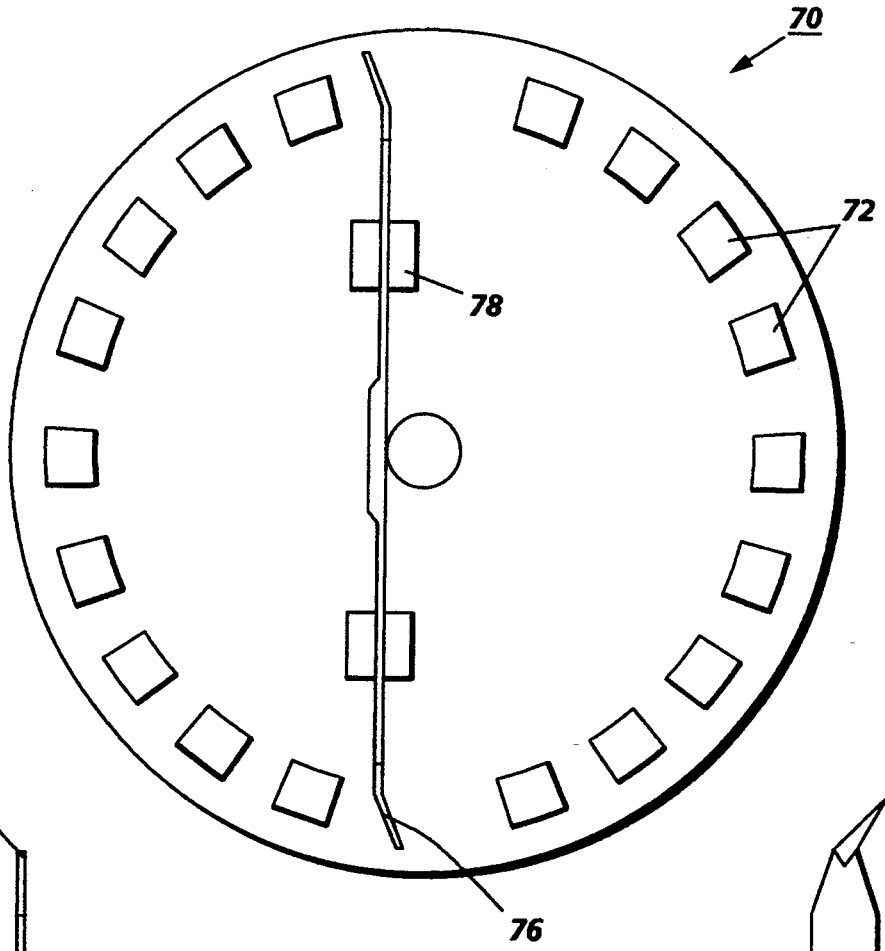
FIG. 9 is another embodiment of a drum supporting hub of this invention.
Figure 10:
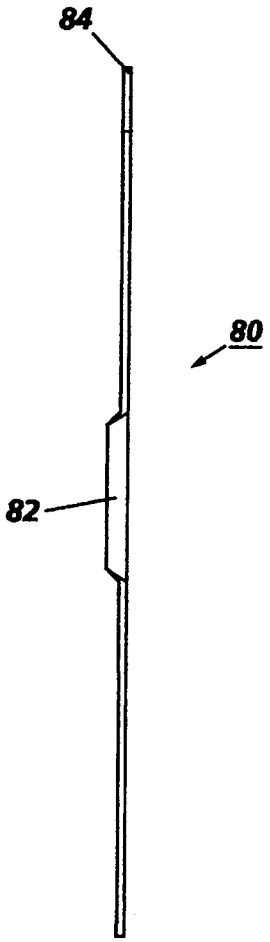
FIG. 10 is still another embodiment of a resilient member of this invention

Still another embodiment of this invention is shown in FIG. 9 in which drum supporting hub 70 comprises a plurality of separate drum alignment projections arranged in a generally circular formation instead of a solid ridge such as semi-circular drum alignment ridges 30 shown in FIG. 4. A long thin substantially flat electrically conductive resilient member 76 is secured to support hub 70 by means of support projections 78. Resilient member 76 may be directly molded into the support projections 78 or merely inserted and glued into slots formed in support projections 78. Any other suitable means of mounting resilient member 76 to hub 70 may be substituted for support projections 78, if desired.

Figure 11:
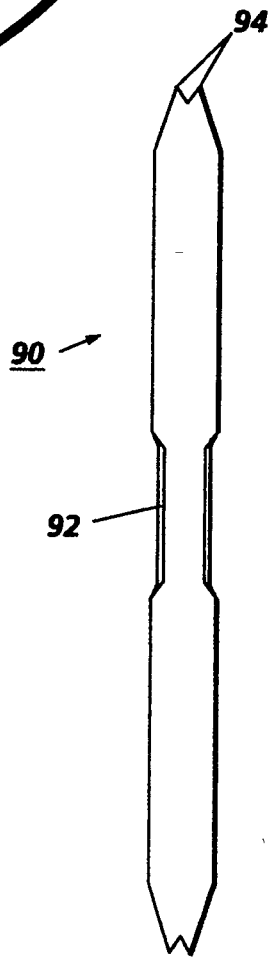
FIG. 11 is an illustration of another embodiment of a resilient member of this invention.

In FIG. 11, another embodiment of a long thin substantially flat electrically conductive resilient member 80 is shown. Resilient member 80 comprises a centrally located flared edge 82 and pointed tip 84 at each end. End region 86 adjacent to tip 84 is not bent and is in the same plane as most of resilient member 80. At least one tapered side 88 leading to pointed tip 4 facilitates entry of resilient member 80 into the interior of the drum when the drum supporting hub (not shown) is twisted into one end a drum (not shown). If only one tapered side is utilized at each end of a resilient member, the tapered side should face the end of the drum into which the hub is inserted. The expression "tapered side" as employed herein is intended to indicate an edge leading to a pointed tip, the edge being inclined relative to the longitudinal centerline of a long thin substantially flat electrically conductive resilient member.

In FIG. 11, another embodiment of a long thin substantially flat electrically conductive resilient member 90 is shown with flared edges 92 and a plurality of pointed tips 94. Although only two pointed tips 94 at each end of resilient member 90 are shown, three or more tips may be utilized if desired.

Figure 12:
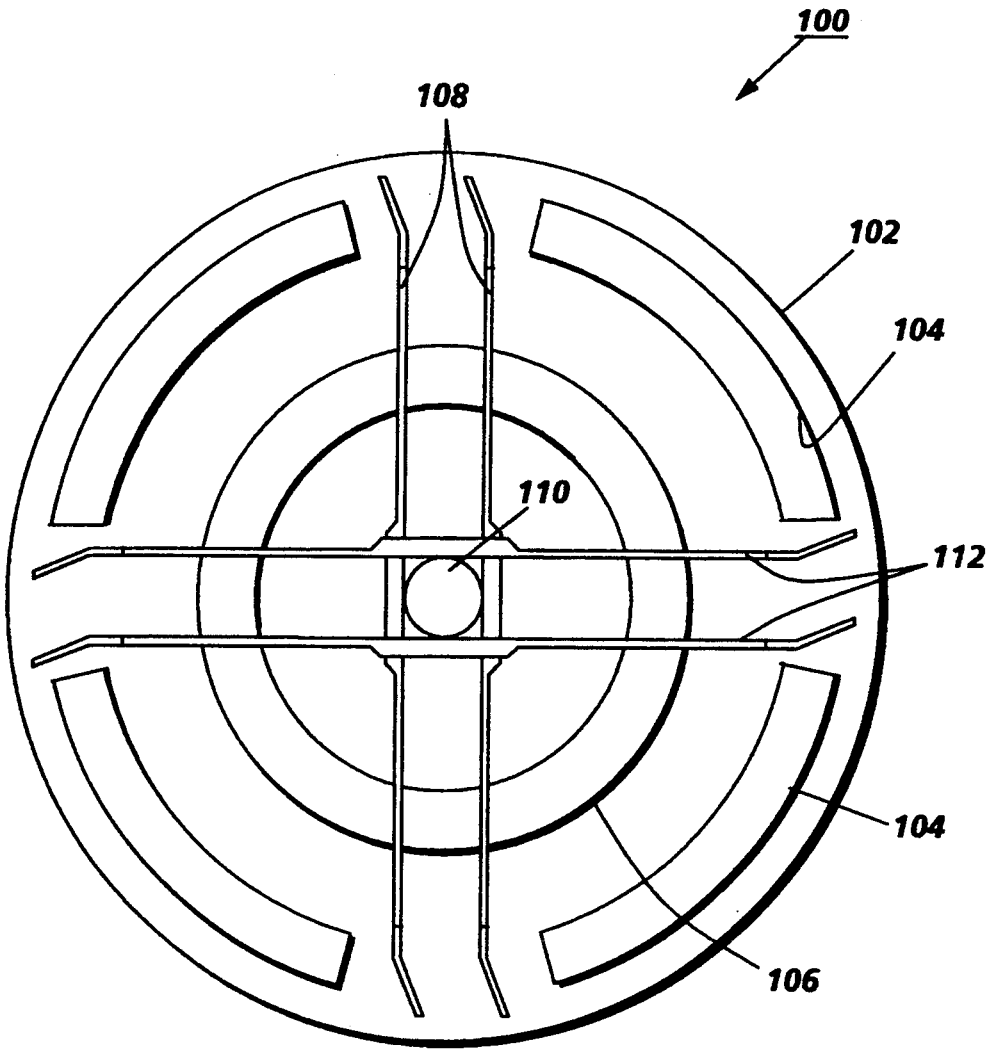
FIG. 12 is schematic, illustration of still another embodiment of a drum supporting hub of this invention.

FIG. 12 illustrates another drum supporting hub 100 of this invention. Hub 100 comprises a disk shaped member 102 bearing arc shaped alignment ridges 104 and a circular ridge 106 which supports a pair of long thin substantially flat electrically conductive resilient members 180 arranged perpendicular to another pair of long thin substantially flat electrically resilient members 112. Resilient members 108 and 112 straddle hole 110 which is provided for an axle shaft (not shown) to increase the surface area available for frictional engagement and electrical contact between resilient members 108 and 112 the exterior surface of an axle shaft and also to promote enhanced self centering of hub 20 and drum (not shown) around the axle shaft. The space between each resilient member of a pair should be slightly less than the diameter of the axle shaft to ensure positive electrical contact with the axle shaft.

Although, the hubs illustrated in the drawings may be identical at each end of the drum, the drum supporting hubs need not be identical.

The invention has been described in detail with particular reference to preferred embodiments thereof but it will be understood that variations and modifications can be effected within the spirit and scope of the invention as described herein above and as defined in the appended claims.

What is claimed is:

1. A drum supporting hub for comprising a disk shaped member having a circular periphery, a hole extending axially through the center of said disk shaped member, and at least one long thin electrically conductive resilient member secured to said disk shaped member, said resilient member having a central section adjacent said hole and having opposite ends, each of said ends terminating into at least one pointed tip adjacent said circular periphery of said disk shaped member for engagement with a cylindrical drum upon insertion of said hub into said drum, and said resilient member having a major plane substantially parallel to the axis of said disk shaped member.

2. A drum supporting hub according to claim 1 wherein said central section has a major plane substantially parallel to the axis of said hole and adapted to engage in frictional contact with an axle inserted through said hole.

3. A drum supporting hub according to claim 2 wherein said tips and adjacent end region of said resilient member are bent in opposite directions from each other.

4. A drum supporting hub according to claim 2 wherein at least an edge of said resilient member facing said disk shaped member is flared in a direction away from said axis of said disk to initially contact said end of said axle as it is inserted through said hole.

5. A drum supporting hub according to claim 4 wherein the edge of said resilient member facing away from said disk shaped member is flared in a direction away from said axis of said disk.

6. A drum supporting hub according to claim 1 wherein each of said ends of said resilient member terminates into a plurality of pointed tips.

7. A drum supporting hub according to claim 1 wherein a first pair of said flat electrically conductive resilient members are mounted parallel to each other on said disk shaped member on opposite sides of said hole with flared edges facing away from said axis.

8. A drum supporting hub according to claim 7 wherein a second pair of said flat electrically conductive resilient members are mounted parallel to each other on said disk shaped member on opposite sides of said hole and perpendicular to said first pair of said flat electrically conductive resilient members.

9. A drum supporting hub according to claim 1 wherein said disk shaped member comprises an annular outer member having a centrally located hole into which a bearing member has been mounted, said flat electrically conductive resilient member being carried by said bearing member.

10. A drum supporting hub according to claim 1 wherein said disk shaped member includes means to center said hub on one end of said hollow cylindrically shaped electrostatographic imaging member.

11. An electrostatographic imaging member assembly comprising a hollow cylindrical electrically conductive substrate having an interior surface and a coated outer surface and a drum supporting hub mounted on at least one end of said conductive substrate, said hub comprising a comprising a disk shaped member having a circular periphery, a hole extending axially through the center of said disk shaped member, and at least one long thin electrically conductive resilient member secured to said disk shaped member, said resilient member having a central region adjacent said hole and having opposite ends bent in opposite directions from each other, and each of said ends terminating into at least one pointed tip embedded into said interior surface of said substrate.

12. An electrostatographic imaging process comprising rotating said electrostatographic imaging member assembly of claim 11 in a direction generally opposite the direction in which each of said ends of said resilient member are bent, forming an electrostatic latent image on said coated outer surface and developing said electrostatic latent image with a toner to form a toner image corresponding to said electrostatic latent image.

13. A process for fabricating an electrostatographic imaging member assembly comprising providing a hollow cylindrically shaped electrostatographic imaging member having an interior surface, a coated outer surface and two ends, providing a drum supporting hub comprising a disk shaped member having a circular periphery, a hole extending axially through the center of said disk shaped member, and at least one long thin electrically conductive resilient member secured to said disk shaped member, said resilient member having a central region adjacent said hole and having opposite ends, each end of said resilient member terminating into at least one pointed tip adjacent said circular periphery of said disk shaped member, and inserting said hub with a twisting motion into one of said ends of said hollow cylindrically shaped electrostatographic imaging member to bend said electrically conductive resilient member whereby said pointed tip at each end of said resilient member engages said interior surface to retain said hub in an end of said hollow cylindrically shaped electrostatographic imaging member.

14. A process according to claim 13 wherein at least an edge of said resilient member facing said disk shaped member is flared in a direction away from said axis of said disk for contact with the end of an axle inserted through said hole.

15. A process according to claim 13 including engaging said flared edge with an axle inserted through said hole whereby said flared edge is urged away from the axis of said disk.

* * * * *